US008532531B2

(12) United States Patent
Shimura et al.

(10) Patent No.: US 8,532,531 B2
(45) Date of Patent: Sep. 10, 2013

(54) IMAGE FORMING APPARATUS COMPRISING A CHARGING UNIT INCLUDING PLURAL CONDUCTIVE FIBERS

(75) Inventors: Masaru Shimura, Yokohama (JP); Masahiro Suzuki, Numazu (JP); Tsuguhiro Yoshida, Suntou-gun (JP); Akihiko Uchiyama, Mishima (JP); Michio Uchida, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 253 days.

(21) Appl. No.: 12/967,557

(22) Filed: Dec. 14, 2010

(65) Prior Publication Data

US 2011/0150532 A1 Jun. 23, 2011

(30) Foreign Application Priority Data

Dec. 17, 2009 (JP) ..... 2009-286886

(51) Int. Cl.
*G03G 21/00* (2006.01)
*G03G 15/16* (2006.01)

(52) U.S. Cl.
USPC ..... 399/129; 399/101; 399/354

(58) Field of Classification Search
USPC ..... 399/101, 129, 175, 353, 354
See application file for complete search history.

(56) References Cited

U.S. PATENT DOCUMENTS

| | | | | |
|---|---|---|---|---|
| 6,009,301 | A * | 12/1999 | Maher et al. | 399/353 |
| 6,229,980 | B1 * | 5/2001 | Ogawa et al. | 399/283 |
| 7,395,004 | B2 * | 7/2008 | Nishikawa | 399/101 X |
| 2008/0193179 | A1 * | 8/2008 | Sugimoto et al. | 399/354 |
| 2009/0232530 | A1 | 9/2009 | Saito | |

FOREIGN PATENT DOCUMENTS

| | | | |
|---|---|---|---|
| CN | 101520624 | A | 9/2009 |
| JP | 6-138751 | A | 5/1994 |
| JP | 9-050167 | A | 2/1997 |
| JP | 11-161043 | A | 6/1999 |
| JP | 2000-181191 | A | 6/2000 |
| JP | 2009-205012 | A | 9/2009 |

* cited by examiner

*Primary Examiner* — Sandra Brase
(74) *Attorney, Agent, or Firm* — Canon USA Inc. IP Division

(57) ABSTRACT

A charging member that charges residual toner on an intermediate transfer belt is a charging brush constituted by conductive fibers including an electric insulating portion and an electric conductive portion. Part of the outer circumferential surface of each conductive fiber is the conductive portion.

8 Claims, 7 Drawing Sheets

IMAGE FORMING APPARATUS COMPRISING A CHARGING UNIT INCLUDING PLURAL CONDUCTIVE FIBERS

BACKGROUND OF THE INVENTION

1. Field of the Invention

The present invention relates to image forming apparatuses, such as copying machines and laser printers, that adopt an intermediate transfer system of an electrophotographic system or an electrostatic recording system for transferring a toner image formed on an image bearing member onto an intermediate transfer member and thereafter transferring the toner image onto a transfer material.

2. Description of the Related Art

A known example of image forming apparatuses, such as copying machines and laser printers, uses an intermediate transfer member.

An image forming apparatus configured to use an intermediate transfer member transfers a toner image formed on the surface of a photosensitive drum serving as a first image bearing member onto an intermediate transfer member in a primary transfer process. Thereafter, by repeating this primary transfer process for a plurality of colors of toner images, the image forming apparatus forms the plurality of colors of toner images on the surface of the intermediate transfer member. Subsequently, as a secondary transfer process, the image forming apparatus transfers the plurality of colors of toner images formed on the surface of the intermediate transfer member onto a transfer material in a batch. The unfixed toner images transferred in a batch on the transfer material are thereafter fixed permanently by the fixing unit to form a full-color image on the transfer material.

At that time, part of the toner images are not sometimes transferred to the transfer material in the secondary transfer process and thus remains on the surface of the intermediate transfer member. By collecting the residual toner by a known cleaning unit, the next image formation can be started.

Japanese Patent Laid-Open No. 9-50167 discloses an image forming apparatus that collects residual toner on the intermediate transfer member after the secondary transfer process from the intermediate transfer member using a charging unit. This proposes a simultaneous transfer cleaning system in which an AC voltage is applied to a roller used as the charging unit to charge the residual toner to a polarity opposite to the charged state of the toner during development, and the residual toner charged to the opposite polarity is thereafter reversely transferred to a photosensitive drum in the next primary transfer process and is collected by a cleaning unit on the photosensitive drum. The above configuration allows the residual toner to be cleaned simultaneously with the primary transfer of the next page, thus allowing continuous image formation without slowing the printing speed.

Japanese Patent Laid-Open No. 2009-205012 discloses a method of using a roller member and a brush member as a charging unit. Specifically, this is configured to scatter residual toner on an intermediate transfer member substantially uniformly with the brush member and to charge the substantially uniformly scattered residual toner with the roller member. However, the use of the brush member as the charging unit may pose the following problem depending on the situation; that is, conductive fibers that constitute the brush member may cause electric discharge that causes a bad quality image. Specifically, an image forming apparatus in which toner is negatively charged during development will be described.

The brush member described above scatters residual toner substantially uniformly by coming into contact with the intermediate transfer member and charges the residual toner to a positive polarity opposite to the charged state of the toner during development when a DC voltage is applied. As shown in FIG. 6A, the brush member 60 is provided with a predetermined amount of entry with respect to the intermediate transfer member 61. Furthermore, the brush member 60 is connected to a voltage application unit (not shown) that applies a positive-polarity voltage. Therefore, conductive fibers 62 that constitute the brush member 60 are bent into contact with the surface of the intermediate transfer member 61 to form a minute gap L to or from the intermediate transfer member 61. At that time, a large number of minute gaps L are generated between the surface of the intermediate transfer member 62 and the conductive fibers 62, as shown in FIG. 6B that is an enlarge view of a contact portion S at which the intermediate transfer member 61 and the conductive fibers 62 contact in FIG. 6A.

FIG. 7 illustrates a cross-sectional view of one of the conductive fibers 62 constituting the brush member 60 over which a conductive agent is dispersed. Since the whole outer circumferential surfaces of the conductive fibers 62 are covered with the scattered conductive agent, the electric conductive portions of the conductive fibers 62 and the intermediate transfer member 61 oppose each other to discharge electricity in all the minute gaps L. This provides discharging points corresponding to the number of the conductive fibers 62 (minute gaps L in which electric discharge occurs).

As a result, residual toner that passes through the charging portion that the brush member 60 forms is overcharged at a positive polarity (opposite polarity to the charged state of the toner during development) at the large number of charging points formed between the brush member 60 and the intermediate transfer member 61, resulting in an excessive charge amount. When the overcharged residual toner is reversely transferred from the intermediate transfer member to the photosensitive drum at the primary transfer portion, the residual toner is reversely transferred to the photosensitive drum while drawing the negative-polarity toner developed on the photosensitive drum because of a large electric field generated in the surrounding, thus causing a bad quality image.

The above tendency is notable under a high-temperature, high-humidity environment in which the charge polarity of the residual toner before coming into contact with the brush member 60 tends to become opposite to the polarity during development. Since the toner itself absorbs moisture under the high-temperature, high-humidity environment, the resistance is low, so that the absolute value of the charge amount of the toner is small. The charge polarity of the residual toner is reversed due to the influence of the positive-polarity voltage received during the secondary transfer, which increases the proportion of positive-polarity toner, so that the foregoing phenomenon is prone to occur.

To reduce overcharging of the residual toner, the number of minute gaps L formed between the conductive fibers 62 constituting the brush member 60 and the intermediate transfer member 61 should be reduced. To reduce the number of minute gaps L, there is a method of reducing the number of points of contact between the residual toner and the conductive fibers 62 by decreasing the density of the conductive fibers 62 to reduce the number of the conductive fibers 62.

However, this method reduces the points of contact between the conductive fibers 62 constituting the brush member 60 and the residual toner, thus resulting in a decrease in the effect of scattering the residual toner. In particular, if there is much residual toner, lumps of residual toner cannot be scattered by the brush member 60 in which the scattering effect is reduced. This excessively reduces the charge amount of the residual toner after it passes through the contact portion between the brush member 60 and the intermediate transfer member 61. As a result, the insufficiently charged residual toner remains on the intermediate transfer member 61 when reversely transferred to the photosensitive drum from the intermediate transfer member 61 in the primary transfer portion, which tends to generate a bad quality image.

The above tendency is notable under a low-temperature, low-humidity environment in which the charge polarity of the residual toner hardly becomes positive. Since the electrical resistance of the toner itself is high, so that the absolute value of the charge amount of the toner during development is large during development under the low-temperature, low-humidity environment, which increases the proportion of negative-polarity residual toner, so that the foregoing phenomenon is prone to occur.

SUMMARY OF THE INVENTION

The present invention provides an image forming apparatus in which bad quality images are reduced by using a brush member that assuredly scatters residual toner while suppressing overcharge or insufficient charge of residual toner.

According to an aspect of the present invention, there is provided an image forming apparatus, including an image bearing member configured to bear a toner image; a rotatable, endless intermediate transfer member; a primary transfer member configured to primarily transfer the toner image from the image bearing member to the intermediate transfer member at a primary transfer portion; a secondary transfer member configured to secondarily transfer the toner image from the intermediate transfer member to a transfer material at a secondary transfer portion; and a charging unit disposed upstream of the primary transfer portion and downstream of the secondary transfer portion in the rotating direction of the intermediate transfer member and configured to charge residual toner on the intermediate transfer member. The charging unit includes a brush member in which a plurality of conductive fibers including an electric insulating portion and an electric conductive portion are bundled. The brush member brushes the surface of the intermediate transfer member with the plurality of conductive fibers with the rotation of the intermediate transfer member. Part of the outer circumferential surface of the conductive fibers serves as the conductive portion, and the other part serves as the insulating portion.

Further features of the present invention will become apparent from the following description of exemplary embodiments with reference to the attached drawings.

DESCRIPTION OF THE EMBODIMENTS

Embodiments of the present invention will be described in detail by way of example with reference to the drawings. The sizes, materials, forms, and relative configuration of components described in the following embodiments may be changed as appropriate depending on the configuration and conditions of an apparatus that incorporates the present invention.

First Embodiment

Figure 1:
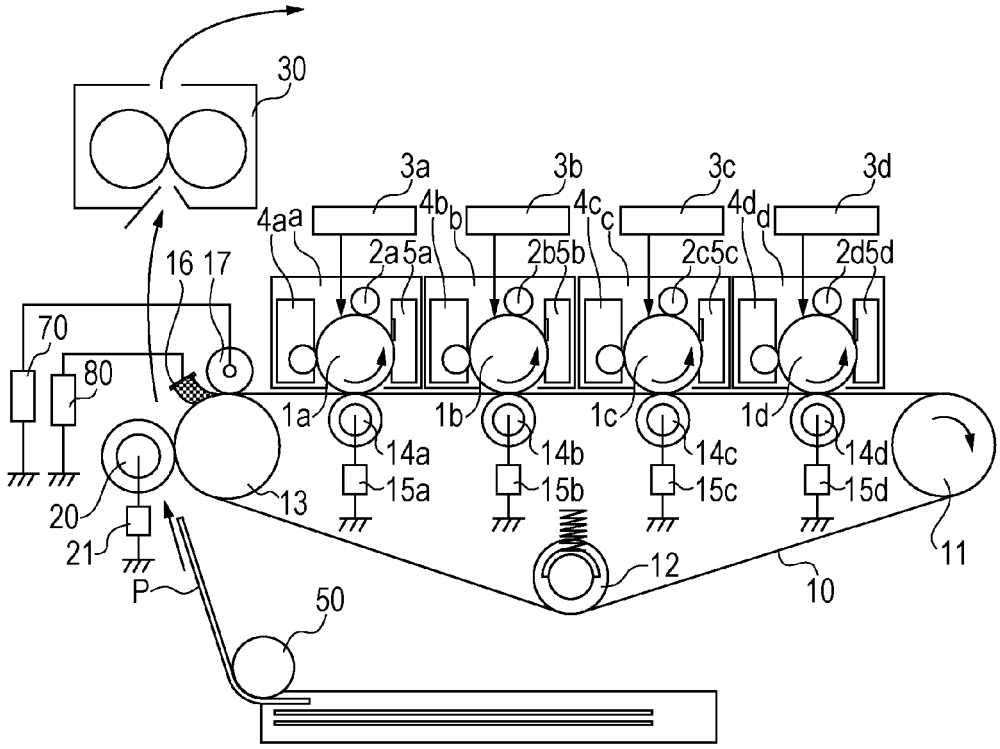
FIG. 1 is a diagram illustrating an image forming apparatus according to a first embodiment.

FIG. 1 is a schematic diagram of an image forming apparatus. The configuration and operation of the image forming apparatus of this embodiment will be described with reference to FIG. 1. The image forming apparatus of this embodiment includes four image forming stations a, b, c, and d. A first image forming station corresponds to yellow (Y), a second image forming station corresponds to magenta (M), a third image forming station corresponds to cyan (C), and a fourth image forming station corresponds to black (Bk). The image forming operation will be described using the first station (Y).

Operation of Image Forming Apparatus

The image forming apparatus includes drum-like photosensitive members (hereinafter referred to as photosensitive drums) 1. The photosensitive drums 1 are rotationally driven in the direction of the arrow at a predetermined circumferential speed (process speed). Here, the first image forming station will be described in detail. The photosensitive drum 1*a* of the first image forming station is an image bearing member that bears a toner image. The photosensitive drum 1*a* is uniformly charged to a predetermined polarity potential by a photosensitive-drum charging roller 2*a* during the rotation process and is then exposed to light by an image exposing unit 3*a*. The photosensitive-drum charging roller 2*a* is for charging the photosensitive drum 1*a*. Thus, an electrostatic latent image corresponding to a yellow component image of a target color image is formed on the photosensitive drum 1*a*. Next, the electrostatic latent image is developed by a first developing unit (yellow developing unit) 4*a* at a developing position to be visualized as a yellow toner image.

A rotatable intermediate transfer member 10 is an endless intermediate transfer belt stretched by a driving roller 11, a tension roller 12, and a facing roller for secondary-transfer 13 (stretching members). The intermediate transfer member 10 rotates at substantially the same circumferential speed as that of the photosensitive drums 1. The yellow toner image formed on the photosensitive drum 1*a* is transferred onto the intermediate transfer belt 10 (primary transfer) while passing through a contact portion (hereinafter referred to as a primary transfer portion) between the photosensitive drum 1*a* and the intermediate transfer belt 10. At that time, a primary transfer voltage is applied to a primary transfer roller 14*a*, which is a primary transfer member, from a primary transfer power supply 15*a*. Residual toner T that remains on the photosensitive drum 1*a* is removed by a cleaning unit 5*a*.

Likewise, a second-color magenta toner image, a third-color cyan toner image, and a fourth-color black toner image are formed by the respective image forming stations and are transferred onto the intermediate transfer belt 10 in sequence to form a combined color image corresponding to the target color image.

The four-color toner images on the intermediate transfer belt 10 are transferred collectively onto the surface of a transfer material P fed by a feeding member 50 during the process of passing through a secondary transfer portion formed between the intermediate transfer belt 10 and a secondary transfer roller 20 that is a secondary transfer member (secondary transfer) At that time, a secondary transfer voltage is applied to the secondary transfer roller 20 by a secondary transfer power supply 21. Thereafter, the transfer material P that bears the four-color toner images are introduced to a fixing device 30, where the transfer material P is heated and pressed, so that the four color toners are melted and mixed and are fixed onto the transfer material P. Thus, a full-color print image is formed.

The residual toner T remaining on the surface of the intermediate transfer belt 10 after the secondary transfer is uniformly scattered onto the intermediate transfer belt 10 (intermediate transfer member) and is uniformly charged by the charging unit. The charging unit is disposed downstream of a secondary transfer nip and upstream of a primary transfer nip in the rotating direction of the intermediate transfer belt 10.

The charging unit of this embodiment includes a charging brush 16 which is a first charging member disposed upstream in the rotating direction of the intermediate transfer belt 10 and a charging roller 17 which is a second charging member disposed downstream.

The residual toner T remains scatteringly on the intermediate transfer belt 10 depending on the pattern of the toner image transferred to the transfer material P. To efficiently charge the residual toner T, it is desirable to charge the residual toner T by a charging member, with the residual toner T scattered into substantially one layer on the intermediate transfer belt 10.

In this embodiment, the residual toner T is uniformly scattered onto the intermediate transfer belt 10 and is charged by the charging brush 16. Thereafter, the residual toner T is charged by the charging roller 17 and is then reversely transferred to the photosensitive drum 1*a* during primary transfer of the next image. At that time, the residual toner T adherent to the photosensitive drum 1*a* is removed by the photosensitive-member cleaning unit 5*a*.

Transfer Configuration

The primary transfer rollers 14*a* to 14*d* have an outside diameter of 12 mm and are formed by covering a nickel-plated steel rod having an outside diameter of 6 mm with foam sponge that is adjusted to a volume resistivity of $10^7$ Ω·cm and a thickness of 3 mm and that is mainly composed of nitrile butadiene rubber (NBR) and epichlorohydrin rubber. The primary transfer rollers 14*a* to 14*d* are brought into contact with the photosensitive drums 1*a* to 1*d*, respectively, via the intermediate transfer belt 10 under a pressure of 9.8 N and are driven with the rotation of the intermediate transfer belt 10. The primary transfer rollers 14*a* to 14*d* are supplied with a voltage of 1,500 V as a primary transfer voltage from the primary transfer power supplies 15*a* to 15*d* to primarily transfer the toner on the photosensitive drums 1*a* to 1*d*, respectively.

The intermediate transfer belt 10 has a thickness of 100 μm and is made from polyvinylidene fluoride (PVDF) whose volume resistivity is adjusted to $10^1$ Ω·cm by mixing with carbon black as a conductive agent. The intermediate transfer belt 10 is stretched across three members, that is, the driving roller 11, the tension roller 12, and the facing roller for secondary-transfer 13, and is stretched by the tension roller at a total tension of 60 N.

The secondary transfer roller 20 is a roller formed by covering a nickel-plated steel rod having an outside diameter of 8 mm with foam sponge that is adjusted to a volume resistivity of $10^8$ Ω·cm and a thickness of 5 mm and that is mainly composed of NBR and epichlorohydrin rubber. The secondary transfer roller 20 is in contact with the intermediate transfer belt 10 under a pressure of 50 N. The secondary transfer roller 20 is driven with the rotation of the intermediate transfer belt 10. When the toner on the intermediate transfer belt 10 is secondarily transferred onto the transfer material P, such as paper, a voltage of 2,500 V is applied as a secondary transfer voltage to the secondary transfer roller 20 from the secondary transfer power supply 21.

This embodiment uses the charging brush 16 and the charging roller 17 as a residual toner T charging unit. The charging brush 16 is configured as an aggregate of a plurality of fibers having electrical conductivity (conductive fibers). The charging brush 16 is supplied with a voltage of 1,000 V from a high-voltage power supply 80 to charge the residual toner T. The configuration of the charging brush 16, which is a feature of this embodiment, will be described later.

An elastic roller that is mainly composed of urethane rubber with a volume resistivity of $10^9$ Ω·cm is used as the charging roller 17 (conductive roller). The conductive roller 17 is pushed against the facing roller for secondary-transfer 13 by a spring (not shown) via the intermediate transfer belt 10 under a total pressure of 9.8 N and is rotated with the rotation of the intermediate transfer belt 10 in the same direction. The conductive roller 17 is supplied with a voltage of 1,500V from a high-voltage power supply 70 to charge the residual toner T. Although this embodiment uses urethane rubber for the conductive roller 17, it is not particularly limited; for example, ethylene propylene rubber or epichlorohydrin rubber may be used.

Method for Cleaning Intermediate Transfer Belt

With the configuration described above, a method for cleaning the intermediate transfer belt 10 will be described with reference to FIG. 2.

In this embodiment, as described above, the toner is negatively charged by the developing units 4*a* to 4*d* and is thereafter developed on the photosensitive drums 1*a* to 1*d*. The toner developed on the photosensitive drums 1*a* to 1*d* is primarily transferred to the intermediate transfer belt 10 by the primary transfer rollers 14*a* to 14*d* that are supplied with a positive voltage by the primary transfer power supplies 15*a* to 15*d*. The toner is transferred to the transfer material P, such as paper, from the intermediate transfer belt 10 by the secondary transfer roller 20 that is supplied with a positive voltage from the secondary transfer power supply 21.

Figure 2:
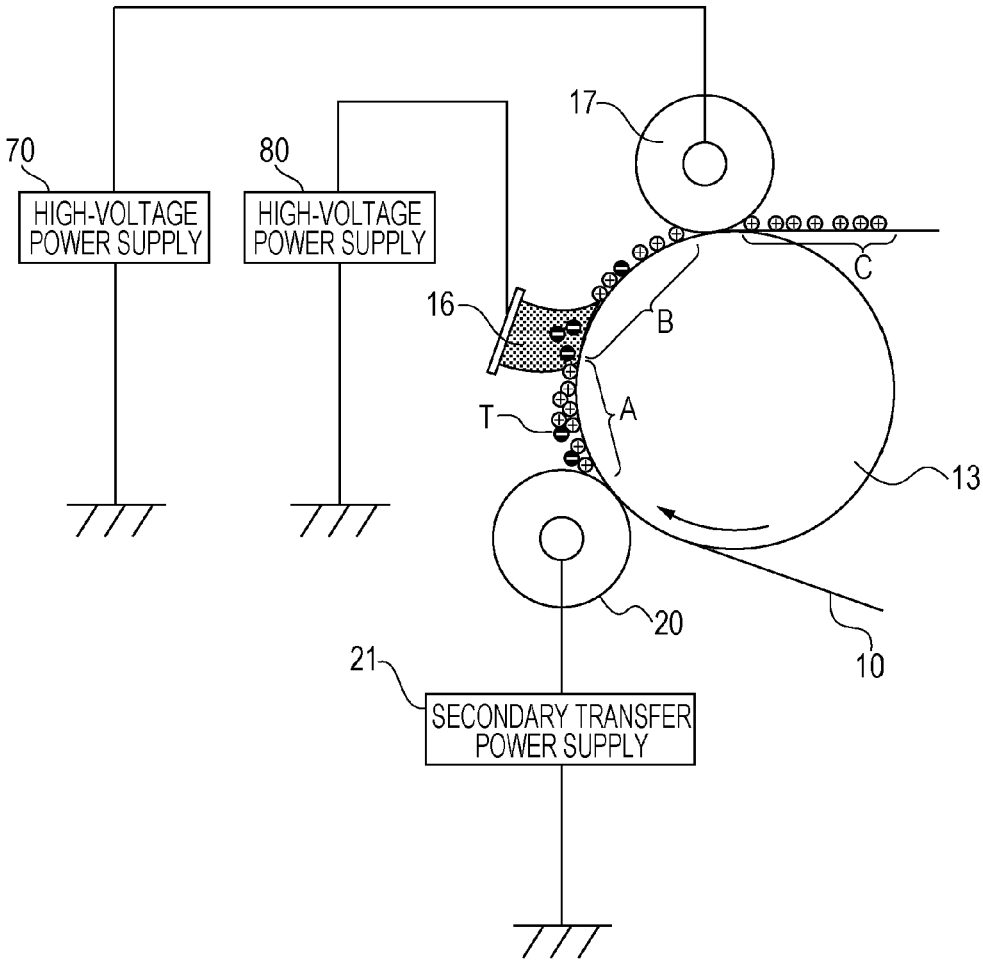
FIG. 2 is a diagram illustrating a cleaning configuration of the first embodiment.

As shown in FIG. 2, the residual toner T remaining on the intermediate transfer belt 10 after the secondary transfer contains both positive-polarity and negative-polarity toners due to the influence of the positive-polarity voltage applied to the secondary transfer roller 20. Furthermore, the residual toner T locally remains in a plurality of layers on the intermediate transfer belt 10 due to the influence of the irregularities of the surface of the transfer material P (portion A in FIG. 2). The multilayered residual toner T is hardly charged as compared with single-layer residual toner. Thus, this embodiment is provided with the charging brush 16.

For the residual toner T remaining on the intermediate transfer member 10, the charging brush 16 located upstream in the rotating direction of the intermediate transfer belt 10 is fixed to the rotating intermediate transfer belt 10 and is disposed at a predetermined amount of entry with respect to the intermediate transfer member 10. The charging brush 16 brushes the surface of the intermediate transfer belt 10 with the rotation of the intermediate transfer belt 10. Therefore, the residual toner T deposited in multiple layers on the intermediate transfer belt 10 is scattered to substantially one layer owing to a difference in speed between the charging brush 16 and the rotating intermediate transfer member 10 (portion B in FIG. 2).

The charging brush 16 is supplied with a positive-polarity voltage (in this embodiment, 1,000 V) from the high-voltage power supply 80, so that the residual toner T is charged to a positive polarity opposite to the toner polarity during development while passing through a charging portion that the charging brush 16 forms. Thereafter, the residual toner T that has passed the charging portion formed by the charging brush 16 moves in the rotating direction of the intermediate transfer belt 10 to reach the conductive roller 17. The conductive roller 17 is supplied with a positive-polarity voltage (in this embodiment, +1,500 V) from the high-voltage power supply 70. The residual toner T that has passed through the charging portion formed by the charging brush 16, where it is charged to a positive polarity, is further charged while passing through a charging portion that the conductive roller 17 forms to be given a positive charge best suited to cleaning (portion C in FIG. 2).

The residual toner T that has given the optimum charge is reversely transferred to the photosensitive drum 1*a* due to the positive-polarity voltage applied to the primary transfer roller 14*a* at the primary transfer portion and is collected to the cleaning unit 5*a* disposed on the photosensitive drum 1*a*.

In this embodiment, the conductive roller 17 is disposed downstream of the charging brush 16 in the rotating direction of the intermediate transfer belt 10. This is for the purpose of making the charge amount of the residual toner T after secondary transfer that has passed through the charging brush 16 more uniform. Accordingly, if the charge amount of the residual toner T is within a predetermined range, the residual toner T can be charged only by the charging brush 16 without the conductive roller 17. The charge amount of the residual toner T often depends on the environment, such as a temperature and humidity during secondary transfer, the charge amount of toner on the intermediate transfer belt 10, and the kind of transfer material; thus, the use of the conductive roller 17 allows variations in the charge amount of the residual toner T described above to be coped with.

Figure 7:
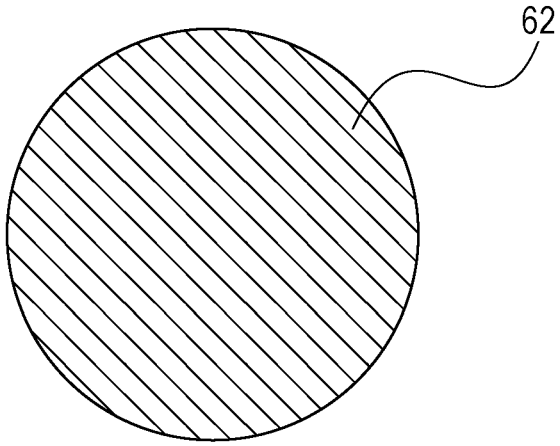
FIG. 7 PRIOR ART
FIG. 7 is a cross-sectional view of one of the conductive fiber in the related art.

Next, the configuration of the charging brush 16 will be described with reference to FIGS. 3A and 3B. The charging brush 16 that charges the residual toner T on the intermediate transfer belt 10 is a bundle of conductive fibers 16*a* including an electric insulating portion 16*b* and an electric conductive portion 16*c*. Here, the insulating portion 16*b* and the conductive portion 16*c* of the conductive fiber 16*a* are different members, not all over which the conductive agent is scattered unlike that described with reference to FIG. 7.

Figure 3A:
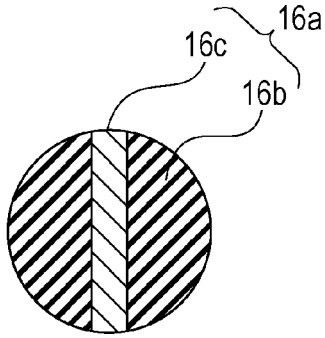
FIG. 3A is a diagram illustrating a conductive fiber of the first embodiment.
Figure 3B:
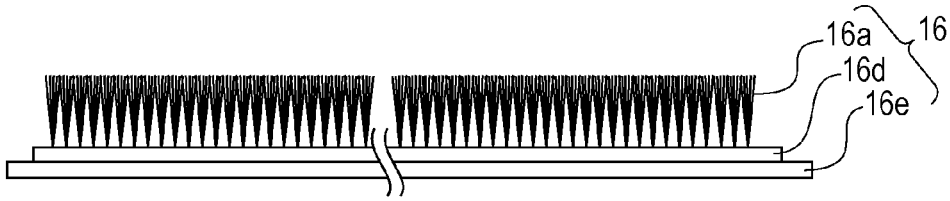
FIG. 3B is a diagram illustrating a charging brush of the first embodiment.

The conductive fibers 16*a* of this embodiment are characterized in that part of the outer circumferential surface thereof is the conductive portion 16*c*, as shown in FIG. 3A.

Specifically, the conductive fibers 16*a* will be described with reference to FIG. 3A that is a cross-sectional view of one of the conductive fibers 16*a* constituting the charging brush 16. The insulating portion 16*b* and the conductive portion 16*c* of the conductive fiber 16*a* are mainly composed of nylon and are configured such that the insulating portion 16*b* sandwiches the conductive portion 16*c* and that the conductive portion 16*c* is exposed at two portions of the outer circumferential surface of the conductive fiber 16*a*. The proportion of the exposed portions when the whole outer circumferential surface is 100% is about 10% in total.

Furthermore, the resistance of one conductive fiber 16*a* per unit length is $10^8$ Ω/cm. The length of the composite conductive fiber 16*a* is 5 mm. FIG. 3B is a diagram illustrating the charging brush 16 configured as an aggregate of the conductive fibers 16*a*. As shown in FIG. 3B, the charging brush 16 is configured such that the conductive fibers 16*a* are fixed to a foundation fabric 16*d* made of electric insulating polyester by being woven therein. Furthermore, the foundation fabric 16*d* is bonded onto a stainless used steel (SUS) plate 16*e* having a thickness of 1 mm with a conductive adhesive. By supporting the plate 16*e* in the apparatus main body, the charging brush 16 is fixed with respect to the intermediate transfer belt 10.

The conductive fibers 16*a* used in this embodiment have a singe-yarn fineness of 5 dtex and a density of 100 kF/inch$^2$. In this embodiment, although the charging brush 16 is configured by the conductive fibers 16*a* that are mainly composed of nylon, it is not particularly limited and may be made of polyester or acryl.

To charge the secondary-transfer residual toner T, the exposure amount of the conductive portion 16*c* of the composite conductive fiber 16*a* is preferably about 5 to 30% in total. To scatter lumps of the residual toner T into substantially one layer, the density of the conductive fibers 16*a* is preferably 20 kF/inch$^2$ to 300 kF/inch$^2$. The end position of the charging brush 16 is fixed at an entry amount of about 1.0 mm with respect to the surface of the intermediate transfer belt 10.

Figure 4A:
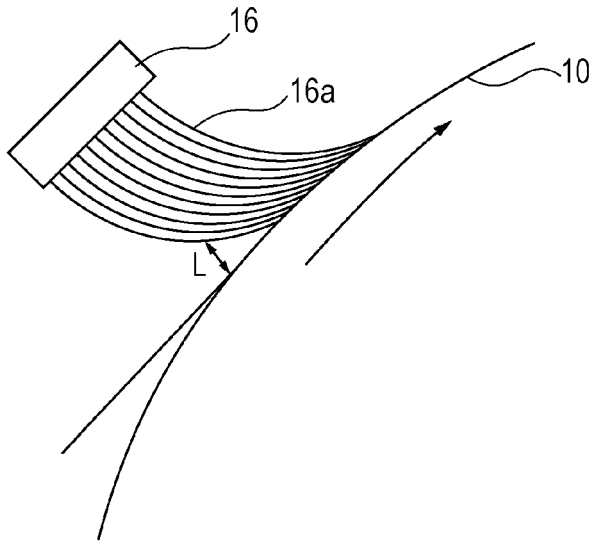
FIG. 4A is a diagram illustrating the operation of the first embodiment.

Next, the operation of this embodiment will be described. Since the charging brush 16 described above has the function of breaking down the deposited state of the residual toner T by coming into contact therewith, the charging brush 16 is provides with a predetermined amount of entry with respect to the intermediate transfer member 10. As shown in FIG. 4A, the conductive fibers 16*a* are in contact with the intermediate transfer member 10 while bending to the rotating direction of the intermediate transfer belt 10. Therefore, a plurality of minute gaps L are formed between the conductive fibers 16*a* and the intermediate transfer belt 10. In general, electric discharge occurs when the potential difference between objects and the size of the gaps therebetween satisfy predetermined relationship. When a predetermined potential difference or more is generated in one gap, electric discharge occurs.

In contrast, this embodiment is configured such that only part of the outer circumferential surface of each conductive fiber 16*a* is the conductive portion 16*c*. The portion of the outer circumferential surface other than the conductive portion 16*c* is the insulating portion. Therefore, the conductive portions 16*c* of all the conductive fibers 16*a* do not always face the intermediate transfer belt 10; therefore, electric discharge do not occur in some minute gaps L formed between the conductive fibers 16*a* and the intermediate transfer belt 10.

Figure 4B:
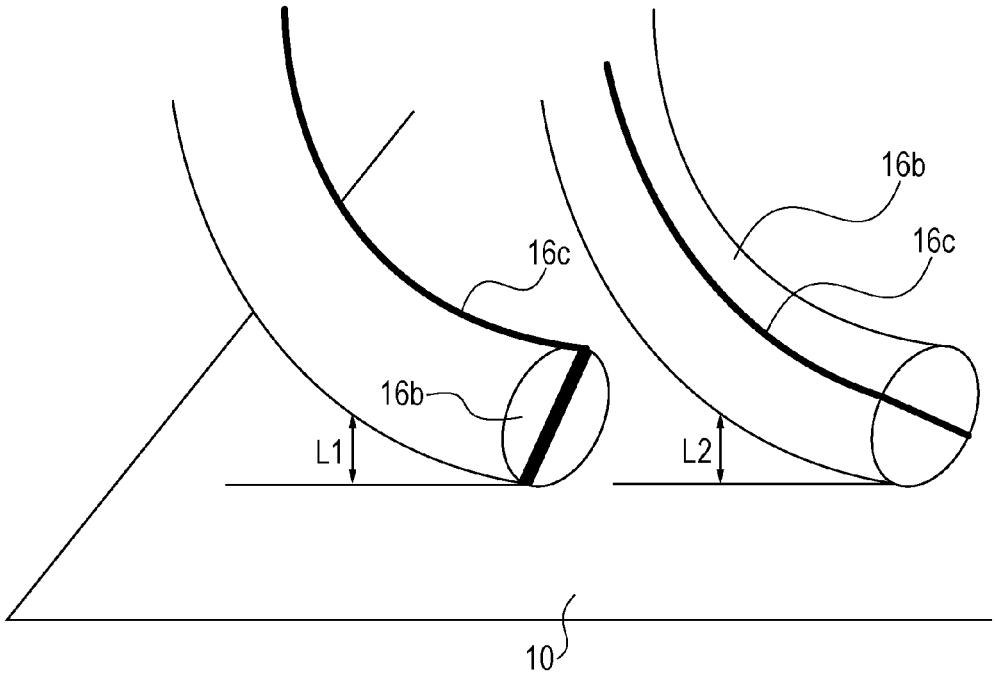
FIG. 4B is an enlarged view of the conductive fibers.

FIG. 4B is a schematic enlarged view of the state of contact between the composite conductive fibers 16*a* and the intermediate transfer belt 10 shown in FIG. 4A.

Referring to FIG. 4B, electric discharge occurs in a minute gap L1 in which the conductive portion 16*c* and the intermediate transfer belt 10 face; however, no electric discharge occurs in a minute gap L2 in which the insulating portion 16*b* and the intermediate transfer belt 10 face. Therefore, electric discharge does not occur in all the minute gaps L formed between the conductive fibers 16*a* and the intermediate transfer belt 10.

Accordingly, the charging brush 16 of this embodiment can reduce the number of minute gaps in which electric discharge occurs without decreasing the density of the conductive fibers 16*a*. Furthermore, since there is no need to decrease the density, sufficient contact points between the conductive fibers 16*a* and the secondary-transfer residual toner T can be provided, thus allowing the charging brush 16 to sufficiently scatter the residual toner T by coming into contact therewith.

The exposure amount of each of the conductive portions 16*c* of the conductive fibers 16*a* constituting the charging brush 16 of this embodiment is about 10% of the outer circumferential surface, as described above. Therefore, the number of conductive fibers 16*a* whose conductive portions 16*c* come into contact with the intermediate transfer belt 10 and form discharging points is about 10% of the whole. That is, of the conductive fibers 16*a* with a density of 100 kF/inch$^2$, the conductive portions 16*c* with a density of 10 kF/inch$^2$, which is 10% of the charging brush 16 of this embodiment when expressed as the density of the charging brush 16, is in contact with the intermediate transfer belt 10. The study conducted by the applicant and the associated person showed that the density of the charging brush 16 of this embodiment at which the secondary-transfer residual toner T can be scattered is 20 kF/inch$^2$ or more. The use of the conductive fibers 16*a* with the configuration of this embodiment can efficiently reduce discharge points and can offer the effect of scattering a sufficient amount of residual toner T.

As described above, according to this embodiment, a charging member that charges the residual toner T on the intermediate transfer belt 10 is the charging brush 16 constituted by the conductive fibers 16*a* including the insulating portion 16*b* and the conductive portion 16*c*. Since only part of the surface of the conductive fiber 16*a* serves as the conductive portion 16*c*, the residual toner T on the intermediate transfer belt 10 can be scattered without forming lumps, thereby preventing overcharging of the secondary-transfer residual toner T. This allows the residual toner T to be charged to a proper charge amount.

In this embodiment, although a bar-type fixed member is used as a cleaning brush, a fur brush type roller that uses the foregoing conductive fibers 16*a* can also offer the same advantages when rotated at a peripheral speed different from that of the intermediate transfer belt 10.

The charging brush 16 of this embodiment can be used more effectively if the intermediate transfer member 10 has an ion conductive resistance characteristic obtained by dispersing hydrophilic macromolecules in polyvinylidene fluoride (PVDF). Since the intermediate transfer belt 10 that exhibits an ion conductive resistance characteristic performs electric conduction via ions, the resistance is more uniform in the surface of the intermediate transfer member 10 than that of the electron conducting intermediate transfer member 10 in which carbon is dispersed. This may be because the intermediate transfer belt 10 that uses hydrophilic macromolecules as a conducting agent conducts electricity by the movement of water ions, so that the resistance of the intermediate transfer member 10 is stable irrespective of the location although the resistance changes depending on the absolute moisture amount. On the other hand, since electronic conductivity is caused when electrons move between conductive fillers, such as carbon, while hopping due to a tunnel effect, the resistance depends on the dispersion state of the conductive fillers.

Therefore, the resistance of the intermediate transfer belt 10 is stable irrespective of the position of contact with the charging brush 16, thus preventing concentration of electric discharge on a specific portion of the intermediate transfer belt 10. This therefore stabilizes electric discharge that occurs between the composite conductive fibers 16*a* and the intermediate transfer belt 10, allowing the residual toner T to be charged more uniformly.

In other words, since the ion conductive intermediate transfer belt 10 has high resistance uniformity in the surface, electric discharge generated between the conductive fibers 16*a* and the intermediate transfer member 10 can easily be stabilized.

Second Embodiment

In the configuration of an image forming apparatus of this embodiment, the same components as those of the first embodiment are given the same reference signs and descriptions thereof will be omitted. The sizes and arrangements of the charging brush 16 and the charging roller 17 used as a residual toner T charging unit are the same as those of the first embodiment.

Figure 5:
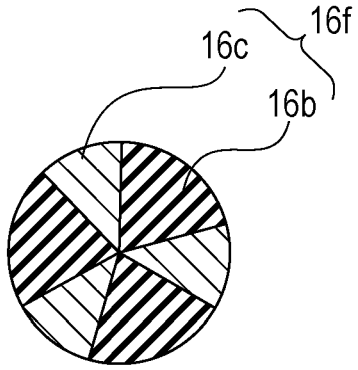
FIG. 5 is a diagram illustrating a conductive fiber used in a second embodiment.
Figure 6A:
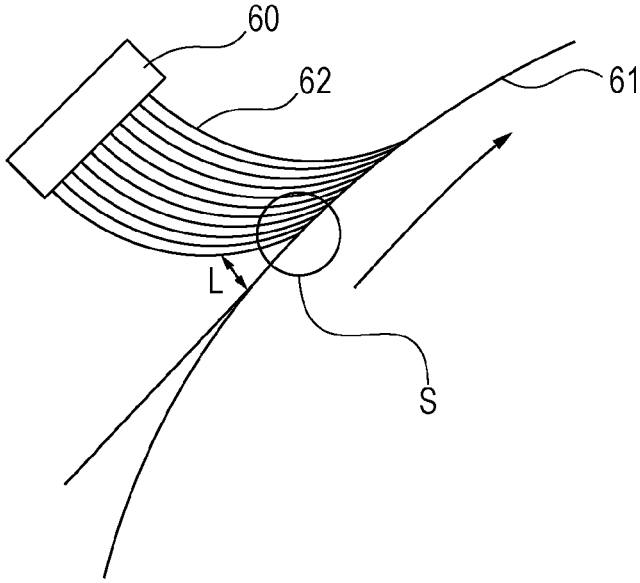
FIG. 6A PRIOR ART
FIG. 6A is a diagram illustrating a brush member in related art.
Figure 6B:
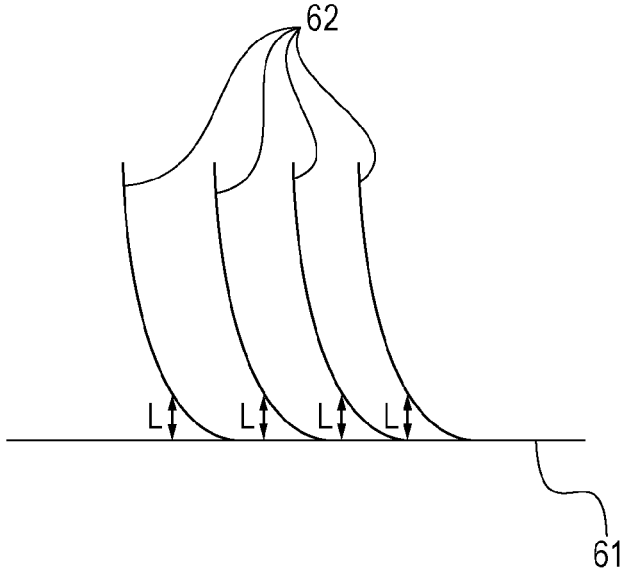
FIG. 6B PRIOR ART
FIG. 6B is a diagram illustrating conductive fibers in the related art.

In this embodiment, conductive fibers 16*f* differ from the composite conductive fibers 16*a* of the first embodiment. The conductive fibers 16*f* are mainly composed of polyester and have a cross-sectional form in which the conductive portion 16*c* and the insulating portion 16*b* are arranged alternately, as shown in FIG. 5. The conductive portion 16*c* of the conductive fiber 16*f* is exposed at three portions on the outer circumferential surface, and the proportion of the exposed portions is 15% in total when the whole outer circumferential surface is 100%. The resistance of one conductive fiber 16*f* per unit length is $10^8$ Ω/cm.

The charging brush 16 configured as an aggregate of conductive fibers 16*f* can be made into a brush form by weaving the composite conductive fibers 16*f* into a fundamental fabric 16*d* formed of electric insulating nylon. The foundation fabric 16*d* is bonded on a SUS plate 16*e* having a thickness of 1 mm with a conductive adhesive. The conductive fibers 16*f* of the charging brush 16 have a singe-yarn fineness of 3 dtex and a density of 70 kF/inch$^2$.

In this embodiment, although the charging brush 16 is configured by the conductive fibers 16*f* that are mainly composed of polyester, it is not particularly limited and may be made of nylon or acryl. The end position of the charging brush 16 is fixed at an amount of entry of about 1.0 mm with respect to the surface of the intermediate transfer belt 10, thus causing a difference in peripheral speed between the charging brush 16 and the intermediate transfer belt 10.

Since the conductive fiber 16*f* having three exposed conductive portions 16*c* have more discharging points at which the intermediate transfer belt 10 and the conductive portion 16*c* face, as in this embodiment, as compared with that having two exposed conductive portions, the residual toner T charging performance is enhanced. In particular, in the case where there is much negatively charged residual toner T, the residual toner T can be charged to a proper charge amount by using the conductive fibers 16*f*.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-286886 filed Dec. 17, 2009, which is hereby incorporated by reference herein in its entirety.

What is claimed is:

1. An image forming apparatus, comprising:

an image bearing member configured to bear a toner image;

a rotatable, endless intermediate transfer member;

a primary transfer member configured to primarily transfer the toner image from the image bearing member to the intermediate transfer member at a primary transfer portion;

a secondary transfer member configured to secondarily transfer the toner image from the intermediate transfer member to a transfer material at a secondary transfer portion; and a charging unit disposed upstream of the primary transfer portion and downstream of the secondary transfer portion in the rotating direction of the intermediate transfer member and configured to charge residual toner on the intermediate transfer member, wherein the charging unit includes a brush member in which a plurality of conductive fibers including an electric insulating portion and an electric conductive portion are bundled, part of the outer circumferential surface of the conductive fibers serves as the conductive portion, and the other part serves as the insulating portion, and wherein the conductive portion of some of the conductive fibers opposes a surface of the intermediate transfer member, and not the conductive portion but the insulating portion of other conductive fibers opposes the surface of the intermediate transfer member.

2. The image forming apparatus according to claim 1, wherein the plurality of conductive fibers are in contact with the intermediate transfer member, and wherein the brush member charges residual toner on the intermediate transfer member by causing discharge in a gap formed by the intermediate transfer member and the conductive portion opposing the intermediate transfer member.

3. The image forming apparatus according to claim 1, wherein the intermediate transfer member is an intermediate transfer member having an ion conductive resistance characteristic.

4. The image forming apparatus according to claim 1, wherein the brush member is in contact with the intermediate transfer member at a predetermined amount of entry.

5. The image forming apparatus according to claim 1, wherein the charging unit includes a charging roller that is disposed upstream of the primary transfer portion and downstream of the brush member in the rotating direction of the intermediate transfer member, that is in contact with the intermediate transfer member, and that rotates in the same direction as that of the intermediate transfer member, and wherein the charging roller charges the residual toner charged by the brush member.

6. The image forming apparatus according to claim 1, wherein the brush member brushes the surface of the intermediate transfer member with the plurality of conductive fibers with the rotation of the intermediate transfer member.

7. The image forming apparatus according to claim 1, wherein a ratio of the conductive portion of the conductive fibers that opposes the intermediate transfer member is 5% to 30%.

8. The image forming apparatus according to claim 1, wherein an exposure amount of the conductive portion of the conductive fibers is 10% of the outer circumferential surface of the conductive fibers.

* * * * *